US009966667B2

(12) United States Patent
Ayala Vazquez et al.

(10) Patent No.: US 9,966,667 B2
(45) Date of Patent: May 8, 2018

(54) ELECTRONIC DEVICE ANTENNA WITH SWITCHABLE RETURN PATHS

(71) Applicant: Apple Inc., Cupertino, CA (US)

(72) Inventors: Enrique Ayala Vazquez, Watsonville, CA (US); Hongfei Hu, Cupertino, CA (US); Nanbo Jin, San Jose, CA (US); Matthew A. Mow, Los Altos, CA (US); Liang Han, Sunnyvale, CA (US); Ming-Ju Tsai, Sunnyvale, CA (US); Erica J. Tong, Pacifica, CA (US); Erdinc Irci, Sunnyvale, CA (US); Salih Yarga, Sunnyvale, CA (US); Mattia Pascolini, San Francisco, CA (US); Benjamin Shane Bustle, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/806,986

(22) Filed: Nov. 8, 2017

(65) Prior Publication Data

US 2018/0069317 A1 Mar. 8, 2018

Related U.S. Application Data

(63) Continuation of application No. 14/811,714, filed on Jul. 28, 2015.

(51) Int. Cl.
*H01Q 1/24* (2006.01)
*H01Q 13/10* (2006.01)

(52) U.S. Cl.
CPC ..... *H01Q 13/103* (2013.01); *H01Q 1/245* (2013.01)

(58) Field of Classification Search
CPC ..... H01Q 13/103; H01Q 1/245
USPC ..... 343/702
See application file for complete search history.

(56) References Cited

U.S. PATENT DOCUMENTS

| | | | |
|---|---|---|---|
| 7,564,411 | B2 | 7/2009 | Piisila et al. |
| 8,106,834 | B2 | 1/2012 | Copeland |
| 9,002,262 | B1 | 4/2015 | Kuo |
| 2007/0001906 | A1 | 1/2007 | Pelzer et al. |
| 2013/0169490 | A1 | 7/2013 | Pascolini et al. |
| 2014/0001022 | A1 | 1/2014 | Weber et al. |
| 2015/0162662 | A1 | 6/2015 | Chen et al. |

OTHER PUBLICATIONS

Hagedon et al., "Bright e-Paper by transport of ink through a white electrofluidic imaging film", Nature Communications, vol. 3, Article No. 1173, 7 pages, DOI:10.1038/ncomms2175, Nov. 6, 2012, URL: www.nature.com/naturecommunications.

(Continued)

*Primary Examiner* — Andrea Lindgren Baltzel
(74) *Attorney, Agent, or Firm* — Treyz Law Group, P.C.; G. Victor Treyz; Michael H. Lyons

(57) ABSTRACT

An electronic device may have wireless circuitry with antennas. An antenna resonating element arm for an antenna may be formed from conductive housing structures running along the edges of a device. The antenna may have a pair of switchable return paths that bridge a slot between the antenna resonating element and an antenna ground. An adjustable component and a feed may be coupled in parallel across the slot. The adjustable component may switch a capacitor into use or out of use and the return paths may be selectively opened and closed to compensate for antenna loading due to the presence of external objects near the electronic device.

20 Claims, 10 Drawing Sheets

(56) References Cited

OTHER PUBLICATIONS

Keilenfeld et al., "Electrofluidic displays using Young—Laplace transposition of brilliant pigment dispersions", Nature Phonics, vol. 3, pp. 292-296, DOI: 10.1038/NPHOTON.2009.68, Apr. 26, 2009, URL: www.nature.com/naturephotonics.

ELECTRONIC DEVICE ANTENNA WITH SWITCHABLE RETURN PATHS

This application is a continuation of U.S. patent application Ser. No. 14/811,714, filed Jul. 28, 2015, which is hereby incorporated by reference herein in its entirety. This application claims the benefit of and claims priority to U.S. patent application Ser. No. 14/811,714, filed Jul. 28, 2015.

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may have wireless circuitry with antennas. An antenna may be formed from an antenna resonating element arm and an antenna ground. The antenna resonating element arm and antenna ground may be formed from metal housing structures or other conductive structures that are separated by a slot. The antenna resonating element arm may, for example, be formed from peripheral conductive structures running along the edges of the metal housing structures and an elongated opening in the metal housing structures may separate the antenna resonating element arm from a planar portion of the metal housing structures that serves as the antenna ground.

The antenna may have a pair of switchable return paths that bridge a slot between the antenna resonating element and an antenna ground. The switchable return paths may include a primary return path switch and a secondary return path switch. Control circuitry can close the primary return path switch while opening the secondary return path switch and vice versa. An adjustable component and a feed may be coupled in parallel across the slot. The adjustable component may switch a capacitor into use or out of use to compensate for antenna loading due to the presence of external objects near the electronic device. The control circuitry can also configure the primary and secondary return path switches to compensate for changes in antenna loading.

The antenna may include a parasitic antenna resonating element arm that extends along the slot and may include additional adjustable components coupled between the parasitic antenna resonating element arm and the antenna ground to ensure satisfactory performance of the antenna in a variety of operating conditions.

DETAILED DESCRIPTION

Figure 1:
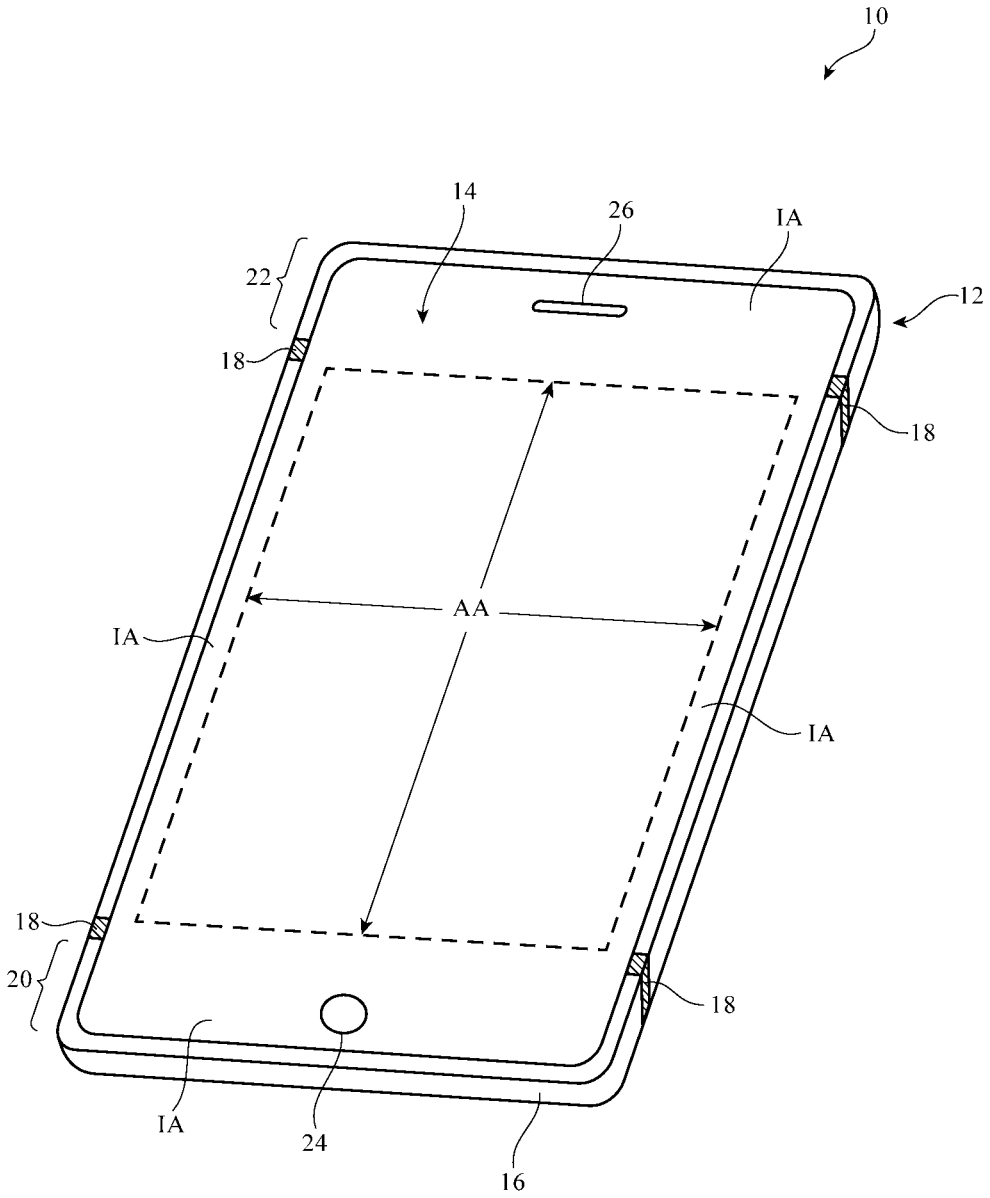
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may be have slots that pass entirely through the rear housing wall and that therefore separate housing wall portions (and/or sidewall portions) of housing 12 from each other. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground plane in device 10, may be located in the center of housing 12 and may extend under active area AA of display 14.

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22. In configurations for device 10 with narrow U-shaped openings or other openings that run along the edges of device 10, the ground plane of device 10 can be enlarged to accommodate additional electrical components (integrated circuits, sensors, etc.)

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
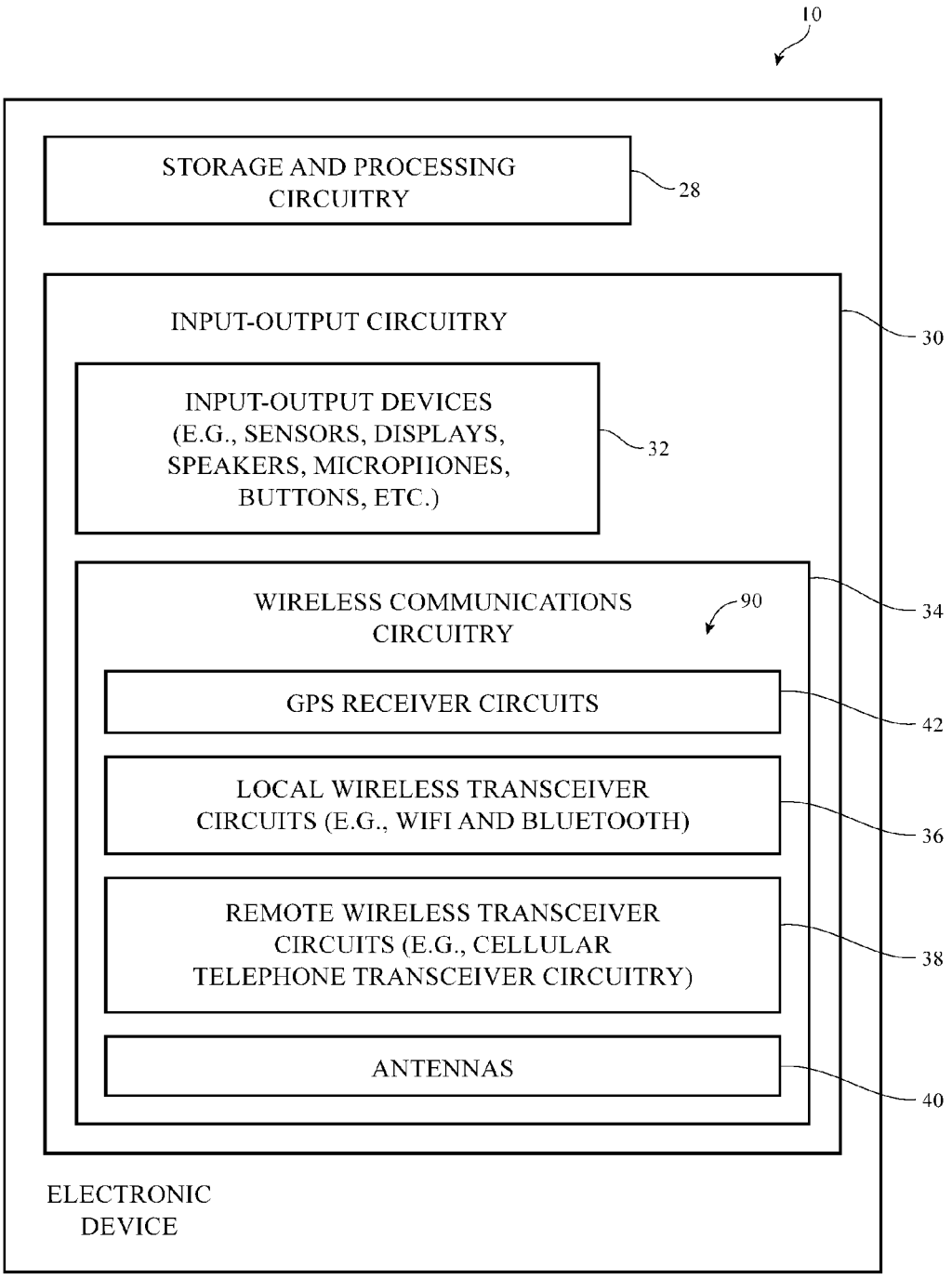
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960 to 1710 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
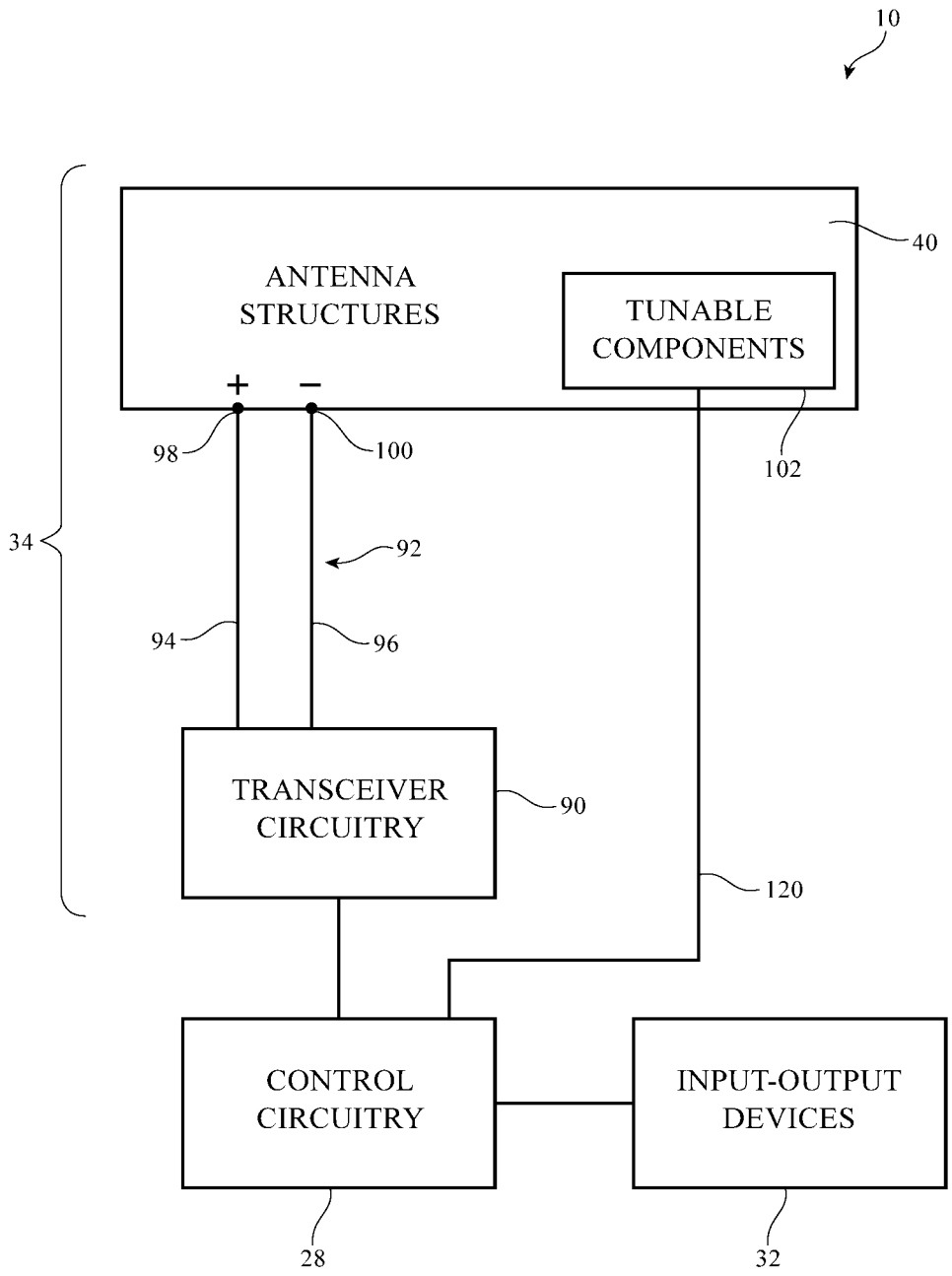
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 120 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. For example, antenna structures 40 may be fed using multiple feeds. The illustrative feeding configuration of FIG. 3 is merely illustrative.

Control circuitry 28 may use an impedance measurement circuit to gather antenna impedance information. Control circuitry 28 may use information from a proximity sensor (see, e.g., sensors 32 of FIG. 2), received signal strength information, device orientation information from an orientation sensor, information from one or more antenna impedance sensors, or other information in determining when antenna 40 is being affected by the presence of nearby external objects or is otherwise in need of tuning. In response, control circuitry 28 may adjust an adjustable inductor, adjustable capacitor, switch, or other tunable component 102 to ensure that antenna 40 operates as desired. Adjustments to component 102 may also be made to extend the coverage of antenna 40 (e.g., to cover desired communications bands that extend over a range of frequencies larger than antenna 40 would cover without tuning).

Figure 4:
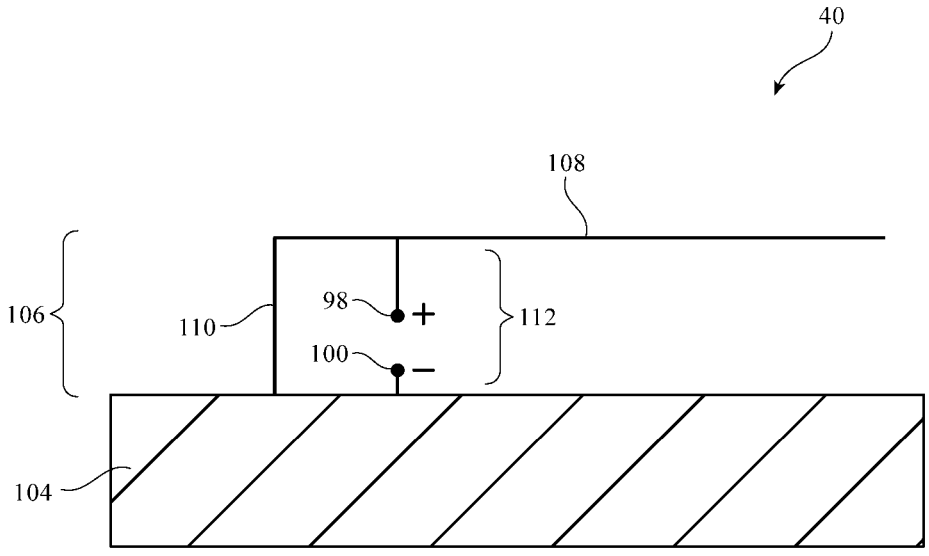
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. An inductor or other component may be interposed in path 110 and/or tunable components 102 may be interposed in path 110 and/or coupled in parallel with path 110 between arm 108 and ground 104.

Antenna 40 may be fed using one or more antenna feeds. For example, antenna 40 may be fed using antenna feed 112. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 108 may have left and right branches that extend outwardly from feed 112 and return path 110. Multiple feeds may be used to feed antennas such as antenna 40.

Figure 5:
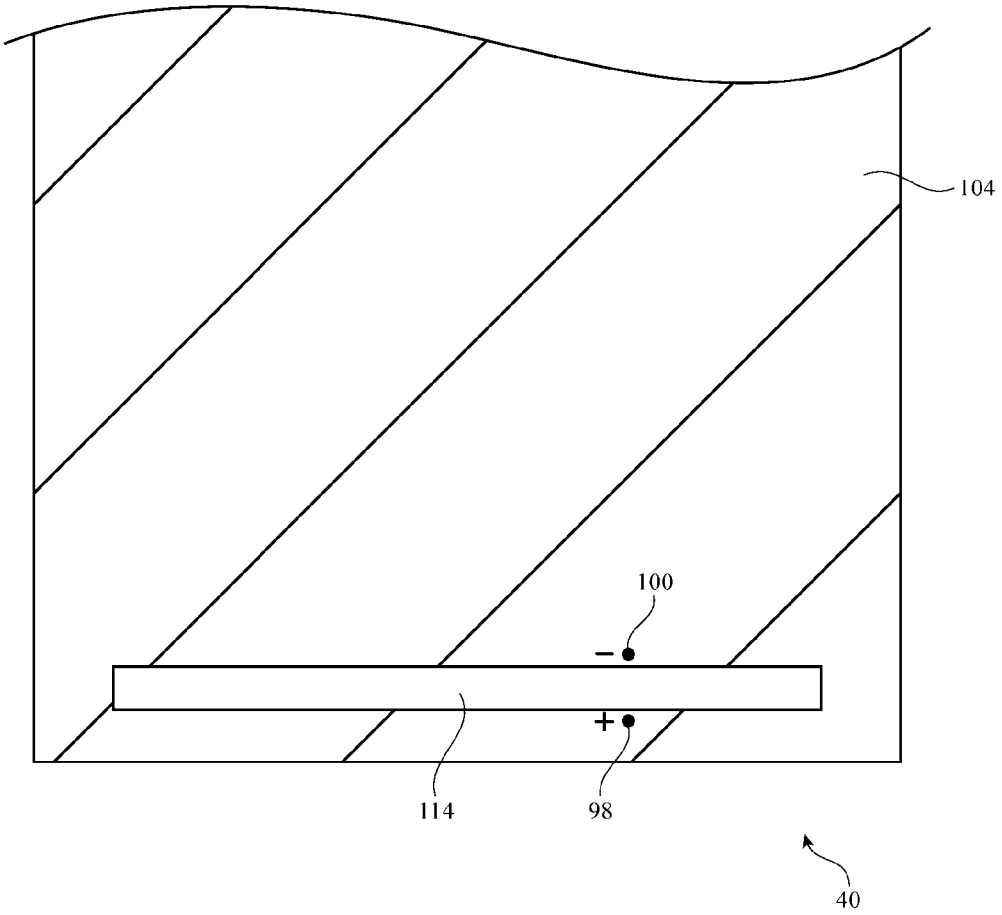
FIG. 5 is a schematic diagram of an illustrative slot antenna in accordance with an embodiment of the present invention.

Antenna 40 may be a hybrid antenna that includes one or more slot antenna resonating elements. As shown in FIG. 5, for example, antenna 40 may be based on a slot antenna configuration having an opening such as slot 114 that is formed within conductive structures such as antenna ground 104. Slot 114 may be filled with air, plastic, and/or other dielectric. The shape of slot 114 may be straight or may have one or more bends (i.e., slot 114 may have an elongated shape following a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 5 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

Figure 6:
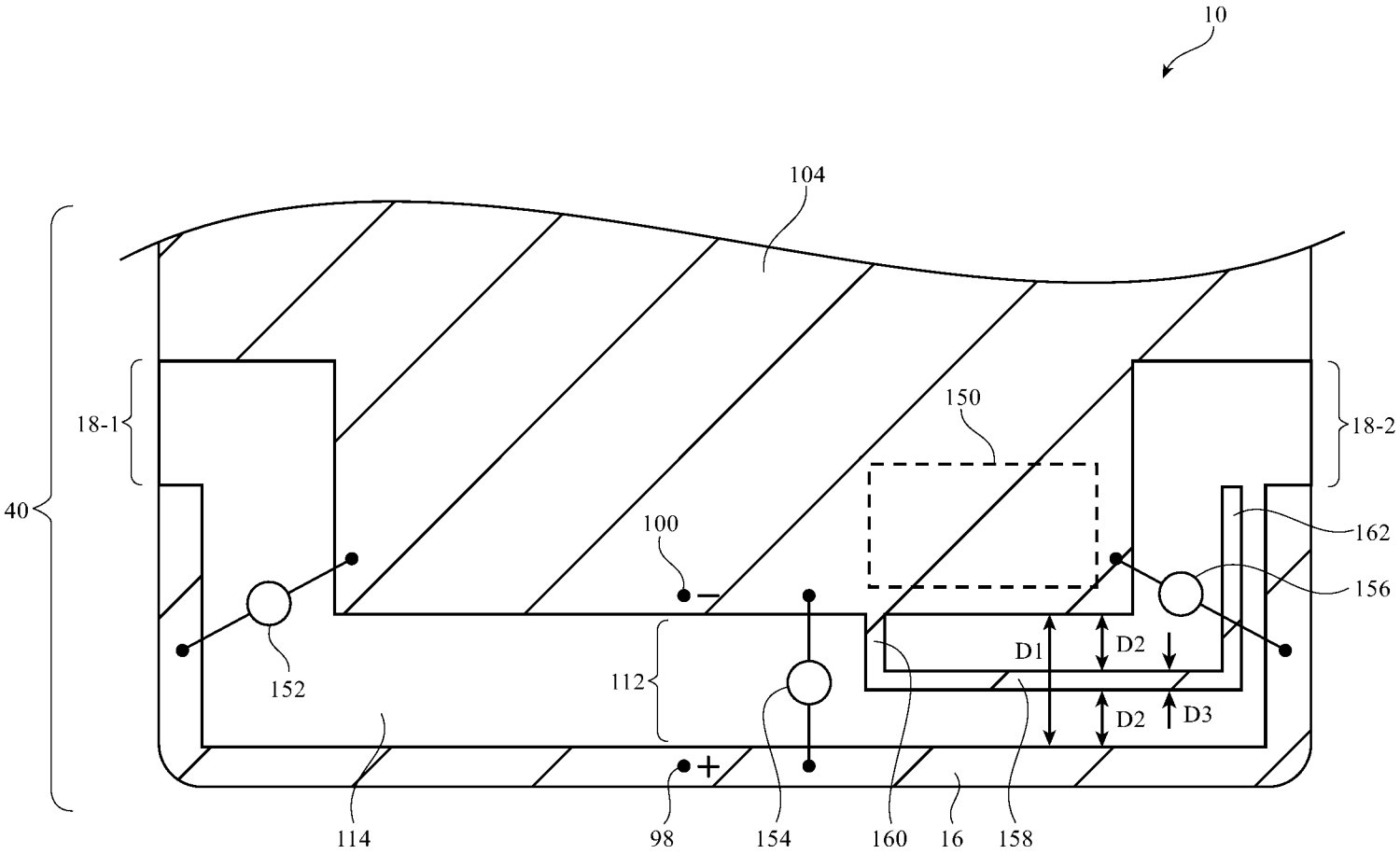
FIGS. 6 and 7 are diagrams of illustrative antenna structures in accordance with an embodiment.

Antenna 40 may be a hybrid slot-inverted-F antenna that includes resonating elements of the type shown in both FIG. 4 and FIG. 5. An illustrative configuration for an antenna with slot and inverted-F antenna structures is shown in FIG. 6. As shown in FIG. 6, antenna 40 (e.g., a hybrid slot-inverted-F antenna) may be fed by transceiver circuitry that is coupled to antenna feed 112. One or more additional feeds may be coupled to antenna 40, if desired. Antenna 40 may include a slot such as slot 114 that is formed from an elongated gap between peripheral conductive structures 16 and ground 104 (e.g., a slot formed in housing 12 using machining tools or other equipment). The slot may be filled with dielectrics such as air and/or plastic. For example, plastic may be inserted into portions of slot 114 and this plastic may be flush with the outside of housing 12.

Portions of slot 114 may contribute slot antenna resonances to antenna 40. Peripheral conductive structures 16 may form an antenna resonating element arm such as arm 108 of FIG. 4 that extends between gaps 18-1 and 18-2 (e.g., gaps 18 in peripheral conductive structures 16). A return path such as path 110 of FIG. 4 may be formed by a fixed conductive path bridging slot 114 or an adjustable component such as a switch that can be closed to form a short circuit across slot 114.

If desired, antenna 40 may be provided with multiple return path switches. For example, a first return path switch may bridge slot 114 at a first location along slot 114 and a second return path switch may bridge slot 114 at a second location along slot 114. When it is desired to form a return path in the first location, the first return path switch may be closed while the second return path switch is opened. When it is desired to form a return path in the second location, the second return path switch may be closed while the first return path switch is opened. Using switchable return paths may provide antenna 40 with flexibility to accommodate different loading conditions (e.g., different loading conditions that may arise due to the presence of a user's hand or other external object on various different portions of device 10 adjacent to various different corresponding portions of antenna 40).

To enhance frequency coverage for antenna 40, antenna 40 may be provided with a parasitic antenna resonating element such as parasitic antenna resonating element 158. Element 158 may be formed as an integral portion of housing 12 (e.g., a portion of housing 12 forming ground 104) and may be embedded within plastic that is molded into slot 114. Device 10 may also have one or more supplemental antennas such as antenna 150 to enhance the frequency coverage of antenna 40. Antenna 150 may be fed using a feed that is separate from feed 112.

Optional adjustable components such as components 152, 154, and 156 (see, e.g., components 102 of FIG. 3) may be used in adjusting the operation of antenna 40. Components 152, 154, and 156 may include switches such as adjustable return path switches, switches coupled to fixed components such as inductors and capacitors and other circuitry for providing adjustable amounts of capacitance, adjustable amounts of inductance, open and closed circuits, etc. Adjustable components in antenna 40 may be used to tune antenna coverage, may be used to restore antenna performance that has been degraded due to the presence of an external object such as a hand or other body part of a user, and/or may be used to adjust for other operating conditions and to ensure satisfactory operation at desired frequencies.

Parasitic antenna resonating element 158 may have a first end such as end 160 that protrudes into slot 114 from antenna ground 104 at a given location along the length of slot 114 and may have a second end such as end 162 that lies within slot 114. Slot 114 may have an elongated shape (e.g., a slot shape) or other suitable elongated gap shape. In the example of FIG. 6, slot 114 has a U shape that runs along the periphery of device 10 between peripheral conductive structures 16 (e.g., housing sidewalls) and portions of the rear wall of device 10 (e.g., ground 104). In this type of configuration, parasitic antenna resonating element 158 may extend from end 160 to end 162 along the length of slot 114 without touching peripheral conductive structures 16 or ground 104 on the opposing side of slot 114 (i.e., without allowing the edges of element 158 to contact the inner surfaces of the metal housing forming slot 114). The ends of slot 114, which may sometimes be referred to as open ends, may be formed by gaps 18 (e.g., gaps 18-1 and 18-2 of FIG. 6).

The length of slot 114 may be about 4-20 cm, more than 2 cm, more than 4 cm, more than 8 cm, more than 12 cm, less than 25 cm, less than 15 cm, less than 10 cm, or other suitable length. Element 158 may have a width D3 of about 0.5 mm (e.g., less than 0.8 mm, less than 0.6 mm, more than 0.3 mm, 0.4 to 0.6 mm, etc.) or other suitable width. Slot 114 may have a width of about 2 mm (e.g., less than 4 mm, less than 3 mm, less than 2 mm, more than 1 mm, more than 1.5 mm, 1-3 mm, etc.) or other suitable width. The length of element 158 may be 1-10 cm, more than 2 cm, 2-7 cm, 1-5 cm, less than 10 cm, less than 5 cm, or other suitable length).

The portions of slot 114 that separate element 158 from ground 104 and peripheral conductive housing structures 16 may have a width D2 of about 0.75 (e.g., more than 0.4, more than 0.6, less than 0.8, less than 1 mm, 0.3-1.2 mm, etc.). Plastic or other dielectric in slot 114 may help hold parasitic resonating element arm 158 in place.

Element 158 may resonate in a desired communications band and thereby provide enhanced frequency coverage for antenna 40 in the desired communications band (e.g., element 158 may resonant at frequencies in a high communications band at 2300-2700 MHz or other suitable band). Element 158 may be formed from a metal structure on a printed circuit, from a portion of a conductive housing structure, or from other conductive structures in device 10.

In the example of FIG. 6, slot 114 has a U shape. If desired, slot 114 may have other shapes such as the straight slot shape of slot 114 of FIG. 7. In an arrangement of the type shown in FIG. 6, the tip of element 158 may be bent to accommodate a bend of slot 114 at the corner of device 10. In the illustrative arrangement of FIG. 7, element 158 is straight and unbent. In other configurations for antenna 40, slot 114 and element 158 may have different shapes. The arrangements of FIGS. 6 and 7 are illustrative.

Figure 7:
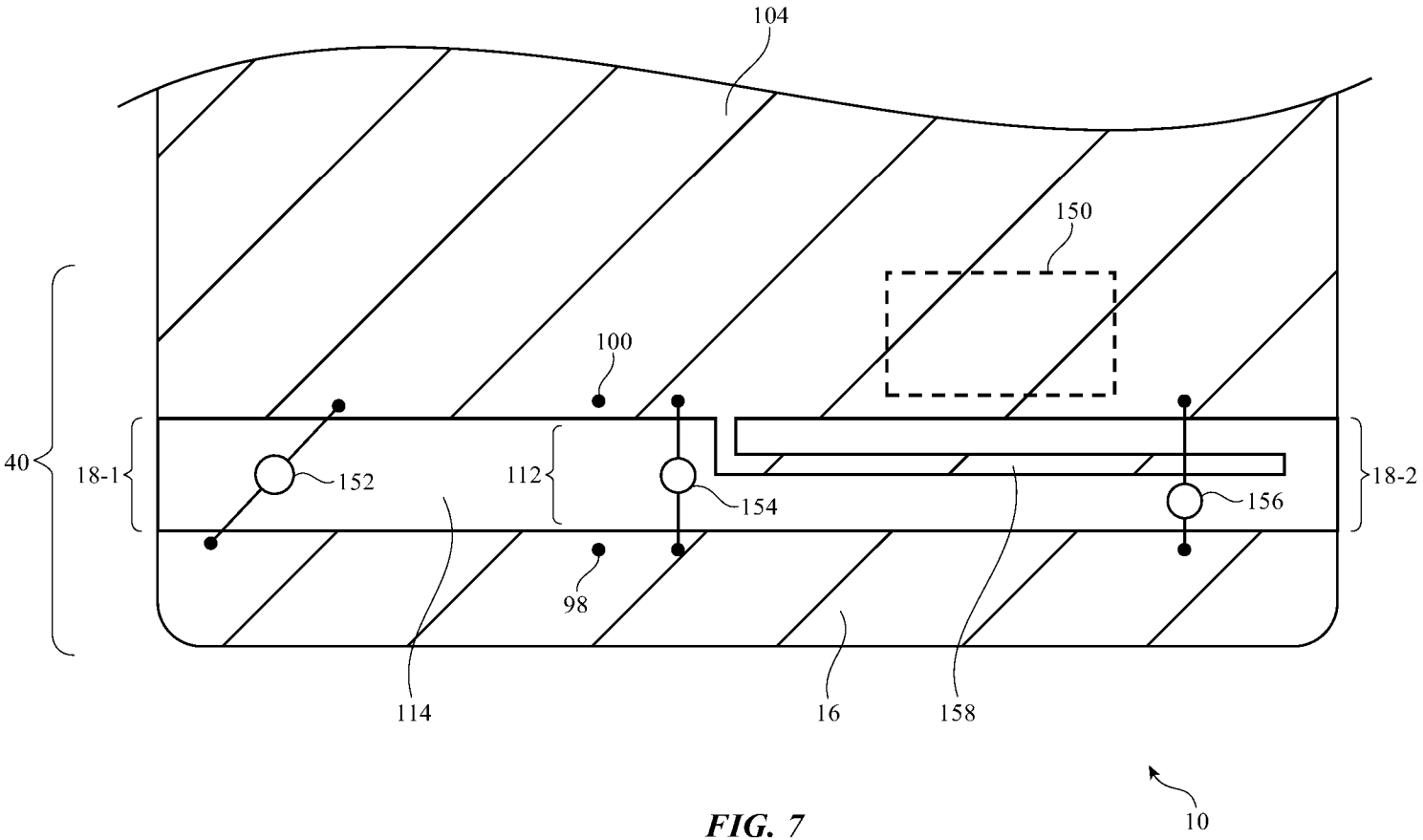
Figure 8:
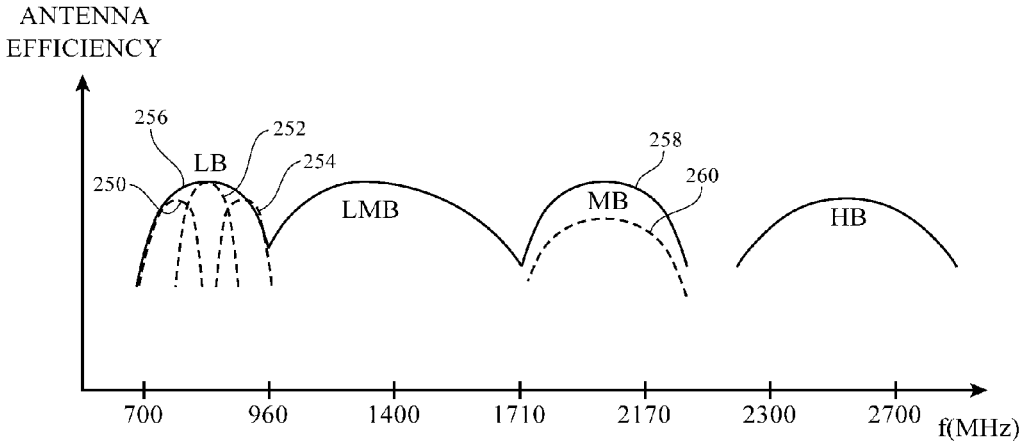
FIG. 8 is a graph in which antenna efficiency has been plotted as a function of operating frequency in accordance with an embodiment.

FIG. 8 is a graph in which antenna efficiency has been plotted as a function of operating frequency f for an illustrative antenna such as antenna 40 of FIGS. 6 and 7 (including parasitic element 158 and supplemental antenna element 150). As shown in FIG. 8, antenna 40 may exhibit resonances in a low band LB, low-middle band LMB, midband MB, and high band HB.

Low band LB may extend from 700 MHz to 960 MHz or other suitable frequency range. Peripheral conductive structures 16 may serve as an inverted-F resonating element arm such as arm 108 of FIG. 4. The resonance of antenna 40 at low band LB may be associated with the distance along peripheral conductive structures 16 between component 152 of FIG. 6 and gap 18-2. Gap 18-2 may be one of gaps 18 in peripheral conductive housing structures 16. FIG. 6 is a rear view of device 10, so gap 18-2 of FIG. 6 lies on the left edge of device 10 when device 10 is viewed from the front. Component 152 may include a switch that can be closed to form a return path for an inverted-F antenna (e.g., an inverted-F antenna that has a resonating element arm formed from structures 16) and/or other return path structures may be formed for antenna 40. A tunable component such as component 154 may be used to tune the response of antenna 40 in low band 40. As shown in FIG. 8, antenna 40 may have an antenna efficiency characterized by curve 256 in low band LB. The antenna efficiency of curve 256 may be achieved by tuning antenna 40 to place antenna 40 in one of three tuning states (e.g., a first state characterized by curve 250, a second state characterized by curve 252, and a third state characterized by curve 254).

Low midband LMB may extend from 1400 MHz to 1710 MHz or other suitable frequency range. An antenna resonance for supporting communications at frequencies in low midband LMB may be associated with a monopole element or other antenna element such as element 150.

High band HB may extend from 2300 MHz to 2700 MHz or other suitable frequency range. Antenna performance in high band HB may be supported by the resonance of parasitic antenna resonating element 158 (e.g., the length of element 158 may exhibit a quarter wavelength resonance at operating frequencies in band HB).

Midband MB may extend from 1710 MHz to 2170 MHz or other suitable frequency range. Antenna 40 may exhibit first and second resonances in midband MB (e.g., resonances at different frequencies within midband MB). A first of these midband resonances may be associated with the distance between feed 112 and gap 18-1. A second of these resonances may be associated with the distance between feed 112 and component 152 (e.g., a switch that may be used in forming a return path).

The presence or absence of external objects such as a user's hand or other body part in the vicinity of antenna 40 may affect antenna loading and therefore antenna performance. For example, in free space, the performance of antenna 40 may be characterized by curve 258 of FIG. 8. In the presence of external loading, however, efficiency may be degraded (see, e.g., degraded efficiency curve 260).

Antenna loading may differ depending on the way in which device 10 is being held. For example, antenna loading and therefore antenna performance may be affected in one way when a user is holding device 10 in the user's right hand and may be affected in another way when a user is holding device 10 in the user's left hand. To accommodate various loading scenarios, device 10 may use sensor data, antenna measurements, and/or other data from input-output circuitry 30 to monitor for the presence of antenna loading (e.g., the presence of a user's hand or other external object). Device 10 (e.g., control circuitry 28) may then adjust adjustable components 102 in antenna 40 to compensate for the loading. With compensation, the performance of an antenna that is being loaded may be restored from a degraded efficiency curve such as curve 260 of FIG. 8 to unimpaired (free space) efficiency curve 258.

Figure 9:
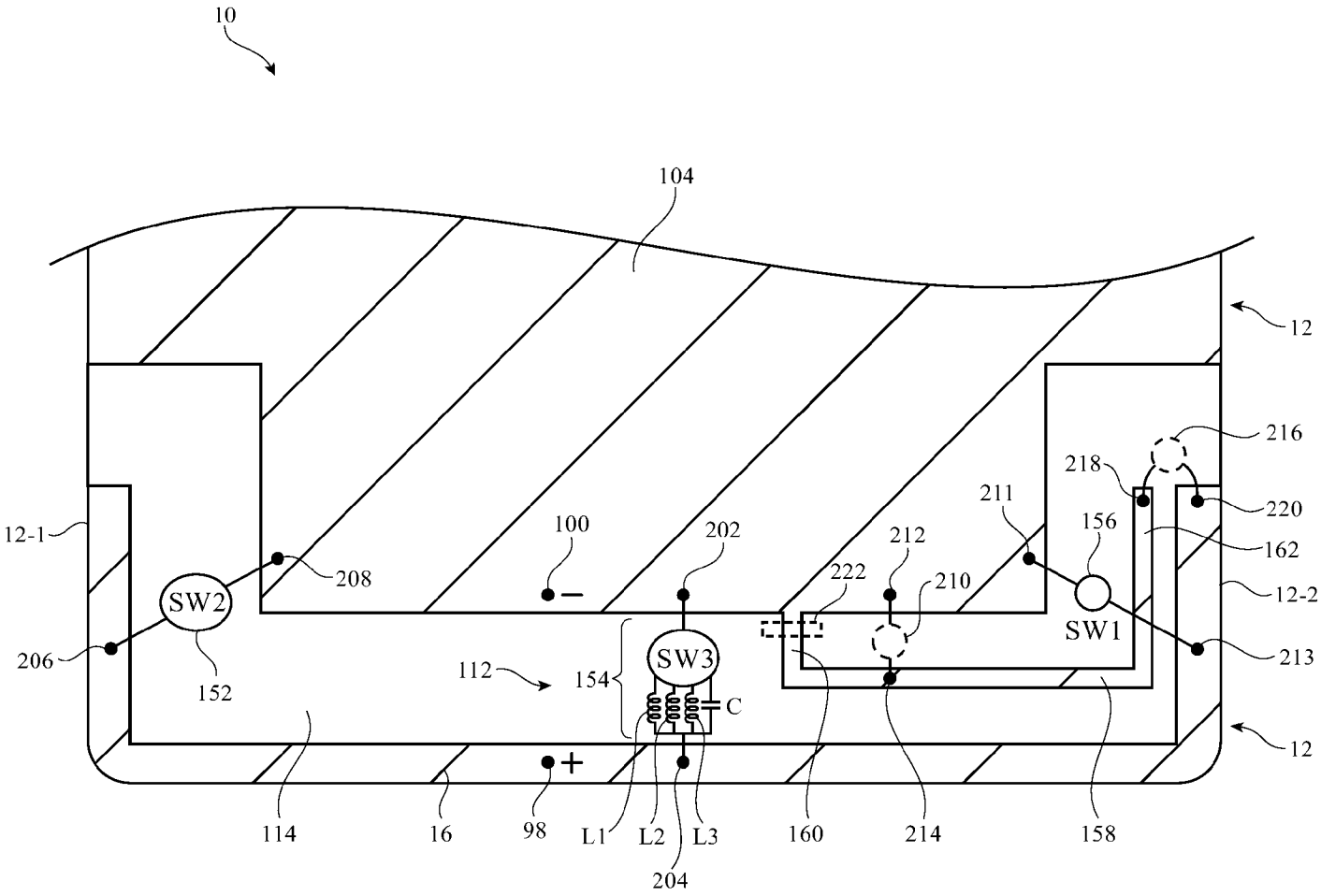
FIG. 9 is a rear view of an illustrative electronic device having an antenna in accordance with an embodiment.

A rear view of device 10 and antenna 40 showing illustrative adjustable components that may be used in adjusting antenna 40 is shown in FIG. 9. As shown in FIG. 9, component 152 may be a switch such as switch SW2 and component 156 may be a switch such as switch SW1. Switches SW1 and SW2 may form configurable return paths that couple an inverted-F resonating element arm formed from peripheral conductive structures 16 to ground 104. Switch SW2 may be associated with a primary return path and may therefore sometimes be referred to as a primary return path switch. Switch SW1 may be associated with a secondary return path and may therefore sometimes be referred to as a secondary return path switch. Switches SW1 and SW2 may be either in an open state (in which the return path associated with the switch is not present) or a closed state (in which the return path associated with the switch is present). Switches SW1 and SW2 may be implemented using field effect transistors that exhibit low ON resistances so that these switches can handle relatively high return path currents during operation of antenna 40.

Switches SW1 and SW2 each have a respective pair of terminals. Switch SW2 is coupled to peripheral conductive structures 16 at terminal 206 and is coupled to ground 104 at terminal 208. Switch SW1 is coupled to peripheral conductive structures 16 at terminal 213 and is coupled to ground 104 at terminal 211. Switches such as switches SW1 and SW2 may sometimes be referred to as single-pole single-throw (SPST) switches. Control circuitry 28 may control the state of switches SW1 and SW2 and other adjustable components 102 by applying control signals to switches SW1 an SW2 during operation of device 10. If desired, switches SW1 and SW2 may be used to introduce a selectable amount of impedance across gap 114 in parallel with or in series with the return paths formed by switches SW1 and SW2 (e.g., to help tune antenna 40). The use of SPST switches that are opened to switch a return path out of use and that are closed to switch a return path into use is merely illustrative.

Adjustable component 154 may include a switch such as switch SW3 and associated components such as inductors L1, L2, and L3 and capacitor C. Using these components, adjustable component (circuit) 154 may apply a desired inductance value (L1, L2, or L3) and/or may apply a fixed capacitance (C) across terminals 202 and 204, or may create an open circuit between terminals 202 and 204. Terminal 202 may be coupled to ground 104 and terminal 204 may be coupled to peripheral conductive structures 16. During use of low band LB, for example, component 154 may apply a tunable amount of inductance (L1, L2, or L3) across terminals 202 and 204, thereby tuning antenna 40 so that antenna 40 exhibits a response in low band LB that is characterized by a respective one of curves 250, 252, and 254 of FIG. 8. Capacitor C can be switched into or out of use as needed to compensate for antenna loading.

When a user is holding device 10 in the user's right hand, the palm of the user's right hand will rest along edge 12-1 of housing 12 and the fingers of the user's right hand (which do not load antenna 40 as much as the user's palm) will rest along edge 12-2 of housing 12. In this situation, loading from the user's hand may affect the midband resonance associated with the distance between feed 112 and primary return path switch SW2. Edge 12-1 is associated with the right edge of housing 12 when device 10 is viewed from the front and edge 12-2 is associated with the left edge of housing 12 when device 10 is viewed from the front.

When a user is holding device 10 in the user's left hand, the palm of the user's left hand will rest along the left edge of device 10 (e.g., housing edge 12-2 of FIG. 9) and the fingers of the user's left hand will rest along edge 12-1 of device 10. In this scenario, the palm of the user's hand may load the portion of antenna 40 near to edge 12-2.

To ensure that antenna 40 operates satisfactorily when the user's right hand is being used to grip device 10 and when the user's left hand is being used to grip device 10 as well as during free space conditions, control circuitry 28 may determine which type of operating environment is present and may adjust the adjustable circuitry of antenna 40 accordingly to compensate. Control circuitry 28 may, in general, use any suitable type of sensor measurements, wireless signal measurements, or antenna measurements to determine how device 10 is being used. For example, control circuitry 28 may use sensors such as temperature sensors, capacitive proximity sensors, light-based proximity sensors, resistance sensors, force sensors, touch sensors, or other sensors to detect the presence of user's hand or other object on the left or right side of device 10. Control circuitry 28 may also use information from an orientation sensor in device 10 to help determine whether device 10 is being held in a position characteristic of right hand use or left hand use (or is being operated in free space). If desired, an impedance sensor or other sensor may be used in monitoring the impedance of antenna 40 or part of antenna 40. Different antenna loading scenarios may load antenna 40 differently, so impedance measurements may help determine whether device 10 is being gripped by a user's left or right hand or is being operated in free space. Another way in which control circuitry 28 may monitor antenna loading conditions involves making received signal strength measurements on radio-frequency signals being received with antenna 40. The adjustable circuitry of antenna 40 can be toggled between different settings and an optimum setting for antenna 40 can be identified by choosing a setting that maximizes received signal strength.

Figure 10:
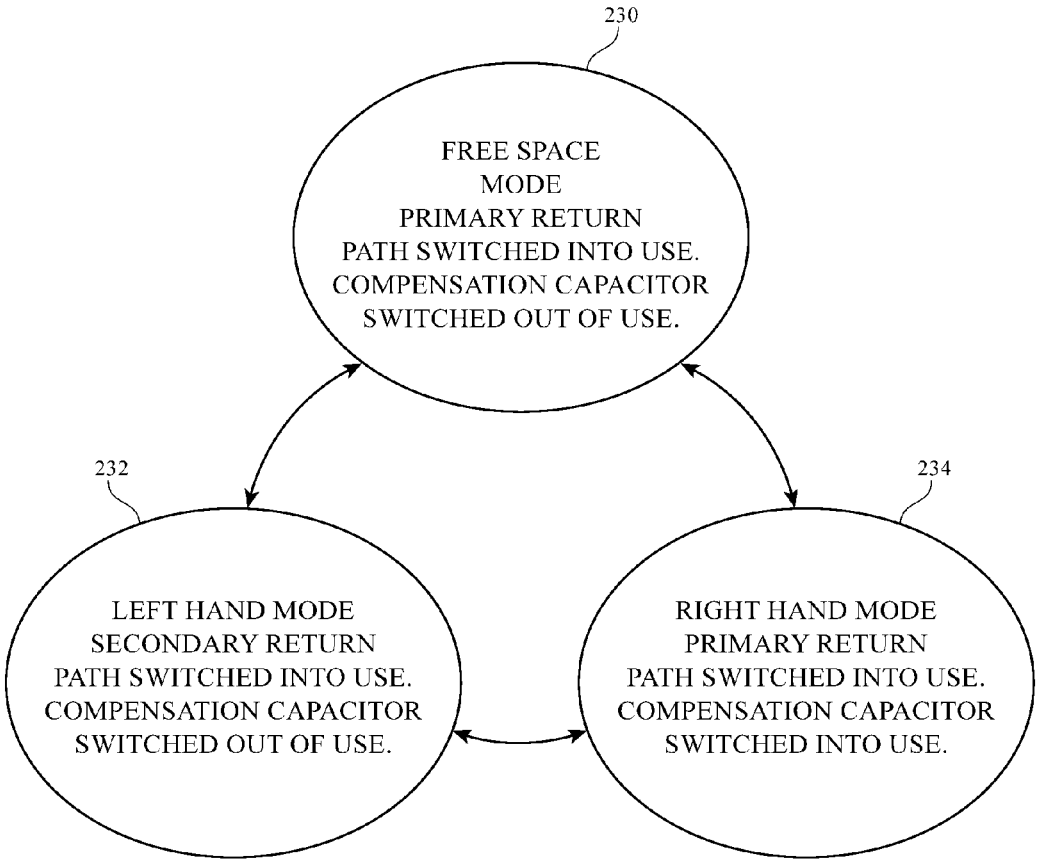
FIG. 10 is a state diagram showing illustrative antenna operating modes for an electronic device in accordance with an embodiment.

A state diagram showing illustrative operating modes for device 10 is shown in FIG. 10. When operating in free space mode 230, device 10 may close primary return path switch SW2 and open secondary return path switch SW1. This switches the primary return path into use. Capacitor C of component 154 may serve as an antenna loading compensation capacitor and need not be used during the operations of free space mode 230. When it is desired to transmit and receive low band signals in band LB, switch SW3 can switch an appropriate one of inductors L1, L2, and L3 into use, thereby tuning the low band response of antenna 40. In free space mode 230, control circuitry 28 may collect and analyze sensor data such as proximity sensor data, orientation sensor data, temperature sensor data, and other sensor data, may collect and analyze received signal strength data, call state data, and other wireless settings, and may collect and analyze antenna performance information such as antenna impedance information and other antenna feedback information to determine whether device 10 is being used in a mode such as a left or right hand grip mode that loads antenna 40 in a way that can be compensated by adjusting the adjustable circuitry of antenna 40.

If it is determined that device 10 is being held in the left hand of a user (i.e., a non-free-space mode in which antenna 40 is being loaded along edge 12-2), control circuitry 28 can adjust the circuitry of antenna 40 to place device 10 in left hand mode (left hand grip mode) 232. In particular, switch SW3 of component 154 may be used to switch capacitor C out of use, primary return path switch SW2 may be placed in an open position, and secondary return path switch SW1 may be closed. This switches the secondary return path of antenna 40 into use in place of the primary return path. By switching the return paths of antenna 40 in this way, antenna efficiency for antenna 40 may be restored to its desired level even in the presence of loading from the left hand of the user. During left hand mode 232, a tunable amount of inductance (L1, L2, or L3, for example) may be switched into use by switch SW3 to tune the response of antenna 40 in low band LB. Control circuitry 28 may monitor for conditions indicating that device 10 is being operated in free space (in which case device 10 can transition to mode 230) or is being held in the right hand of the user (in which case device 10 can transition to right hand mode 234).

If it is determined that device 10 is being held in the right hand of a user (i.e., a non-free-space mode in which antenna 40 is being loaded along edge 12-1), control circuitry 28 can adjust the circuitry of antenna 40 to place device 10 in right hand mode 234. In particular, switch SW3 of component 154 may be used to switch capacitor C into use across slot 114. When capacitor C is switched into use, the midband resonance for antenna 40 is reduced and thereby restored to its desired frequency range in band MB. Primary return path switch SW2 be placed in its closed position so that switch SW2 serves as the return path for antenna 40 while secondary return path switch SW1 may be placed in its open position so that the secondary return path is switched out of use. A tunable amount of inductance (L1, L2, or L3, for example) may be switched into use to tune the response of antenna 40 in low band LB. During right hand mode 234, control circuitry 28 may monitor for conditions indicating that device 10 is being operated in free space (in which case device 10 can transition to mode 230) or is being held in the left hand of the user (in which case device 10 can transition to left hand mode 232).

If desired, antenna 40 may be provided with one or more optional tuning circuits such as optional adjustable components 222, 216, and 210. Optional component 222 may be tunable inductor that is inserted in series in parasitic antenna resonating element arm 158 to tune the length of arm 158 and thereby adjust the resonant frequency of antenna 40 in high band HB. Optional component 216 may have a first terminal such as terminal 220 that is coupled to peripheral conductive structures 16 (which may serve as resonating element arm 108 in antenna 40) and a second terminal such as terminal 218 that is coupled to end 162 of parasitic antenna resonating element arm 158. Component 216 may be a capacitor that enhances high band efficiency for antenna 40. Optional component 210 may have a first terminal such as terminal 212 that is coupled to ground 104 and a second terminal such as terminal 214 that is coupled to antenna resonating element arm 158. Component 210 may be a switchable inductor with a switch that can switch an inductor into use between terminals 212 and 214 to help restore high band performance after the peak efficiency for high band HB has been pulled low by hand capacitance in left hand mode. Other adjustable components 102 may be used to adjust antenna 40 if desired. The adjustable components of FIG. 9 are merely illustrative.

The foregoing is merely illustrative and various modifications can be made by those skilled in the art without departing from the scope and spirit of the described embodiments. The foregoing embodiments may be implemented individually or in any combination.

What is claimed is:

1. An antenna comprising:

a resonating element arm having opposing first and second ends;

an antenna ground;

an antenna feed having a first feed terminal coupled to a first location on the resonating element arm and having a second feed terminal coupled to the antenna ground;

a first adjustable component coupled between a second location on the resonating element arm and the antenna ground, the second location being interposed between the first location and the first end of the resonating element arm;

a second adjustable component coupled between a third location on the resonating element arm and the antenna ground; and a third adjustable component coupled between a fourth location on the resonating element arm and the antenna ground, wherein the third location is interposed between the first and fourth locations and the fourth location is interposed between the third location and the second end of the resonating element arm.

2. The antenna defined in claim 1, wherein the antenna is configured to convey radio-frequency signals in a first frequency band and a second frequency band that is higher than the first frequency band.

3. The antenna defined in claim 2, wherein the second adjustable component is configured to tune the antenna within the first frequency band.

4. The antenna defined in claim 3, wherein the first adjustable component is configured to tune the antenna within the second frequency band.

5. The antenna defined in claim 3, wherein the third adjustable component is configured to tune the antenna within the second frequency band.

6. The antenna defined in claim 5, wherein the first adjustable component is configured to tune the antenna within the second frequency band.

7. The antenna defined in claim 6, wherein the first frequency band comprises frequencies between 700 MHz and 960 MHz and the second frequency band comprises frequencies between 1710 MHz and 2170 MHz.

8. The antenna defined in claim 1, wherein the first, second, and third adjustable components each comprises a respective switch coupled to respective fixed inductors.

9. The antenna defined in claim 1, wherein the second adjustable component comprises a first switch and three inductors, wherein the first switch is coupled in series between the three inductors and the antenna ground and the three inductors are coupled in parallel between the first switch and the third location on the resonating element arm.

10. The antenna defined in claim 9, wherein the first adjustable component comprises a second switch and the third adjustable component comprises a third switch.

11. The antenna defined in claim 10, wherein the antenna is configured to operate in a selected one of a first state in which the second switch forms an open circuit between the second location on the resonating element arm and the antenna ground and the third switch forms a first short circuit path and a second state in which the third switch forms an open circuit between the fourth location on the resonating element arm and the antenna ground and the first switch forms a second short circuit path.

12. The antenna defined in claim 11, wherein the antenna is configured to convey radio-frequency signals in a first frequency band and a second frequency band that is higher than the first frequency band, the first switch is configured to tune the antenna within the first frequency band, a first portion of the resonating element arm between the first and fourth locations on the resonating element arm support a resonance of the antenna in the second frequency band in the first state, and a second portion of the resonating element arm between the first and second locations on the resonating element arm support the resonance of the antenna in the second frequency band in the second state.

13. An electronic device comprising:

peripheral conductive housing structures that run around a periphery of the electronic device, wherein a segment of the peripheral conductive housing structures extends from a first dielectric gap in the peripheral conductive housing structures to a second dielectric gap in the peripheral conductive structures;

an antenna ground;

an antenna resonating element arm formed from the segment of the peripheral conductive housing structures;

an antenna feed having a first feed terminal coupled to a first point on the antenna resonating element arm and a second feed terminal coupled to the antenna ground;

a first adjustable inductor coupled between a second point on the antenna resonating element arm and the antenna ground;

a second adjustable inductor coupled between a third point on the antenna resonating element arm and the antenna ground; and an adjustable component coupled between a fourth point on the antenna resonating element arm and the antenna ground, wherein the third and fourth points are interposed between the first point and the second dielectric gap and the second point is interposed between the first point and the first dielectric gap.

14. The electronic device defined in claim 13, wherein the first adjustable inductor comprises a first switch and the second inductor comprises a second switch.

15. The electronic device defined in claim 14, wherein the adjustable component comprises a third switch coupled to the antenna ground and three inductors coupled in parallel between the third switch and the fourth point on the antenna resonating element arm.

16. The electronic device defined in claim 15, further comprising:

control circuitry configured to control the first, second, and third switches, wherein the control circuitry is configured to operate the electronic device in a first state in which the first switch is open and the second switch is closed and in a second state in which the first switch is closed and the second switch is open.

17. The electronic device defined in claim 16, wherein the control circuitry is configured to control the third switch to couple a selected subset of the three inductors between the antenna ground and the fourth point on the antenna resonating element arm.

18. The electronic device defined in claim 17, further comprising:

radio-frequency transceiver circuitry;

a transmission line coupled between the radio-frequency transceiver circuitry and the antenna feed; and an impedance sensor that gathers impedance information associated with the antenna resonating element arm, wherein the control circuitry is configured to adjust the electronic device between the first and second states based on the impedance information gathered by the impedance sensor.

19. The electronic device defined in claim 17, wherein the antenna ground is separated from the segment of the peripheral conductive housing structures by a slot that has a first end defined by the first dielectric gap in the peripheral conductive housing structures and a second end defined by the second dielectric gap in the peripheral conductive housing structures, wherein first and second adjustable inductors and the adjustable component bridge the slot, the slot has a first, second, and third segments, the second segment extends from a first end of the first segment to the second dielectric gap and the third segment extends from a second end of the first segment to the first dielectric gap, and the second segment extends substantially parallel to the third segment and substantially perpendicular to the first segment.

20. An electronic device comprising:

a conductive housing having peripheral conductive housing structures, wherein a segment of the peripheral conductive housing structures extends between first and second dielectric gaps in the peripheral conductive housing structures;

a resonating element arm formed from the segment of the peripheral conductive housing structures;

an antenna ground separated from the segment of the peripheral conductive housing structures by the first and second dielectric gaps and a slot extending between the first and second dielectric gaps;

an antenna feed having a first feed terminal coupled to the resonating element arm and having a second feed terminal coupled to a first location on the antenna ground;

a first adjustable component coupled between the resonating element arm and a second location on the antenna ground, the second location being interposed between the first location and the first dielectric gap in the peripheral conductive housing structures;

a second adjustable component coupled between the resonating element arm and a third location on the antenna ground, wherein the second adjustable component comprises a switch coupled to the third location on the antenna ground and three inductors coupled in parallel between the switch and the resonating element arm; and a third adjustable component coupled between the resonating element arm and a fourth location on the antenna ground, wherein the third location is interposed between the first and fourth locations on the antenna ground and the fourth location is interposed between the third location on the antenna ground and the second dielectric gap in the peripheral conductive housing structures.

* * * * *